US011933131B2

(12) United States Patent
Lee

(10) Patent No.: US 11,933,131 B2
(45) Date of Patent: Mar. 19, 2024

(54) PACKER ASSEMBLY FOR DEFORMING WELLBORE CASING

(71) Applicant: Paul Bernard Lee, Kelowna (CA)

(72) Inventor: Paul Bernard Lee, Kelowna (CA)

( * ) Notice: Subject to any disclaimer, the term of this patent is extended or adjusted under 35 U.S.C. 154(b) by 140 days.

(21) Appl. No.: 17/442,598

(22) PCT Filed: Apr. 9, 2020

(86) PCT No.: PCT/GB2020/050933
§ 371 (c)(1),
(2) Date: Sep. 23, 2021

(87) PCT Pub. No.: WO2020/225525
PCT Pub. Date: Nov. 12, 2020

(65) Prior Publication Data

US 2022/0170340 A1 Jun. 2, 2022

(30) Foreign Application Priority Data

May 9, 2019 (GB) ..... 1906522

(51) Int. Cl.
*E21B 33/12* (2006.01)
*E21B 33/128* (2006.01)
*E21B 34/08* (2006.01)

(52) U.S. Cl.
CPC ..... *E21B 33/1208* (2013.01); *E21B 33/128* (2013.01); *E21B 34/08* (2013.01); *E21B 2200/04* (2020.05)

(58) Field of Classification Search
CPC ..... E21B 43/103–105; E21B 34/08; E21B 33/128; E21B 33/1208
See application file for complete search history.

(56) References Cited

U.S. PATENT DOCUMENTS

| | | | | |
|---|---|---|---|---|
| 4,708,208 | A | 11/1987 | Halbardier | |
| 4,869,324 | A | 9/1989 | Holder | |
| 10,947,802 | B2 * | 3/2021 | Hrupp | E21B 23/01 |
| 2004/0159445 | A1 | 8/2004 | Hazel et al. | |
| 2005/0077053 | A1 * | 4/2005 | Walker | E21B 33/1295 166/123 |

(Continued)

FOREIGN PATENT DOCUMENTS

| | | | |
|---|---|---|---|
| EP | 3266976 | A1 | 1/2018 |
| WO | 2004089608 | A2 | 10/2004 |

*Primary Examiner* — Theodore N Yao
(74) *Attorney, Agent, or Firm* — KIRTON McCONKIE; Evan R. Witt

(57) ABSTRACT

A packer assembly (2) for deforming casing (4) is described. Packer assembly (2) comprises a first body portion (8) removably connectable to a second body portion (10). An elastomeric packer element (12) is disposed on the first body portion (8) and is configured to be deformed into an outwardly deployed condition in response to actuation of at least one piston (14) disposed on the second body portion (10). A locking means (16) is disposed on the first body portion (8) and is configured to retain the elastomeric packer element (12) in the outwardly deployed condition after it has deformed casing (4). The first body portion (8) can be disconnected from the second body portion (10) after the elastomeric packer element is deployed to deform casing (4) to enable retrieval of the second body portion (10) from the wellbore.

14 Claims, 3 Drawing Sheets

(Position 2)

(56) References Cited

U.S. PATENT DOCUMENTS

| | | | | |
|---|---|---|---|---|
| 2006/0016597 | A1 | 1/2006 | Emerson | |
| 2013/0048308 | A1 | 2/2013 | Lehr et al. | |
| 2013/0175035 | A1* | 7/2013 | Lee | E21B 33/122 166/298 |
| 2016/0177658 | A1* | 6/2016 | Lee | E21B 23/04 166/305.1 |
| 2020/0270967 | A1* | 8/2020 | Fong | E21B 33/1293 |

* cited by examiner (Position 1)

(Position 2)

(Position 3)

(Position 4)

PACKER ASSEMBLY FOR DEFORMING WELLBORE CASING

A packer assembly for deforming wellbore casing to provide a seal in a wellbore is disclosed.

When a wellbore has come to the end of its life producing hydrocarbons such as oil or gas, it is desirable to safely seal the wellbore in what is known as a plug and abandonment operation to prevent any leakage of hydrocarbons and other materials into the environment. In a plug and abandonment operation, it is generally required to create a barrier above the formation that has produced oil and gas. These formations are often permeable and porous and are at low pressure since they have produced hydrocarbons for many years.

When operators perforate wellbore casings in such formations, it can be necessary to attempt to pump material into the low pressure formation to ensure that cement will not simply be sucked into the formation to prevent sealing. Many types of material have been used for this in the past, such as for example sawdust, mattress insulation and tampons.

A preferred embodiment of a packer assembly seeks to overcome the above disadvantages of the prior art.

A packer assembly for deforming casing located in a wellbore is disclosed, the assembly comprising:

- a first body portion removably connectable to a second body portion;
- an elastomeric packer element disposed on said first body portion, said elastomeric packer element configured to be deformed into an outwardly deployed condition in response to actuation of at least one piston disposed on said second body portion; and
- locking means disposed on said first body portion to retain said elastomeric packer element in the outwardly deployed condition;
- wherein said first body portion can be disconnected from said second body portion after said elastomeric packer element is moved to the outwardly deployed condition to deform casing in a wellbore in which the assembly is disposed to enable retrieval of said second body portion from said wellbore.

This provides the advantage of a packer assembly that can be used to deform wellbore casing to provide either an annular seal between concentric casing sections or a casing and an open wellbore. This is advantageous because a seal is created above a formation to be abandoned to enable a reliable and straightforward cementing operating to be performed to form a seal above the formation.

By providing a first body portion that can be disconnected from the second body portion this provides the advantage that part of the assembly can be left in the wellbore with the elastomeric packer element deployed outwardly to prevent elastic deformation of the deformed wellbore casing which can result in seal failure.

This also provides the advantage that the relatively costly hydraulic section of the tool can be retrieved to the surface for reuse.

Furthermore, this provides the additional advantage that the part of the assembly left in the wellbore can be used as a seat for a cement plug.

In a preferred embodiment, said second body portion defines a first portion of a longitudinal bore and wherein said at least one piston is mounted concentrically to said first portion of said longitudinal bore on said second body portion;

- said at least one piston further comprising a piston chamber in fluid communication with said first portion of said longitudinal bore such that an increase in fluid pressure in said first portion of said longitudinal bore causes said at least one piston to move along said second body portion to push said elastomeric packer element and deform said elastomeric packer element into the outwardly deployed condition.

This provides the advantage of a means of enabling the force available to deform the elastomeric packer element to be increased or decreased depending on the particular wellbore and casing requirements. By mounting pistons concentrically on the second body portion, the number of pistons can be increased to increase the force available. Alternatively, the number of pistons can be decreased if required.

In a preferred embodiment, the assembly further comprises at least one annular port to enable wellbore fluid to be vented during operation of said at least one piston.

In a preferred embodiment, the assembly further comprises a plurality of pistons mounted in series on said second body portion.

In a preferred embodiment, said locking means comprises:

- a first plurality of teeth disposed on an outer surface of said first body portion; and
- a ratchet member having a second plurality of teeth disposed thereon for engagement with said first plurality of teeth;
- wherein said ratchet member is able to move in a first direction along said first body portion during deformation of said elastomeric packer element but is prevent from movement in a second direction, opposite to said first direction by engagement of said first and second pluralities of teeth.

This provides the advantage of a relatively straightforward locking means to enabling the elastomeric packer element to be locked in the deployed condition to maintain the deformation of the casing. This therefore reduces the risk of seal failure.

In a preferred embodiment, said ratchet member comprises a split ring.

In a preferred embodiment, said locking means further comprises a ratchet retainer ring in engagement with said elastomeric packer element.

In a preferred embodiment, said first and second body portions are connectable by means of corresponding screw threads.

This provides the advantage of a means of enabling the first and second body portions to be disconnected to facilitate retrieval of the hydraulic section to the surface for reuse. This also provides the advantage of enabling the packer element to remain downhole to ensure casing deformation and therefore seal integrity.

In a preferred embodiment, said second body portion can be disconnected from said first body portion by unscrewing the second body portion in the clockwise direction relative to said first body portion.

This provides the advantage of a straightforward means for operators on the surface to disconnect the first and second body portions. In most wellbore operations such as drilling, a work string is rotated in the clockwise (right hand) direction. As a consequence, if the first and second body portions are connected by a left hand thread, then rotating the work string in which the assembly is disposed in an clockwise (right hand) direction after the elastomeric packer element is deployed to create a reaction force will enable disconnection of the two body portions.

In a preferred embodiment, said first body portion defines a second portion of said longitudinal bore, and wherein said first body portion comprises first valve means disposed in said second portion of said longitudinal bore, the first valve means arranged to permit fluid to enter said second portion of said longitudinal bore when the assembly is moved into a wellbore containing fluid.

This provides the advantage of providing a fluid bypass. To be most effective, the packer assembly must be dimensioned to be very close in tolerance to the internal diameter of the casing to be deformed. This means that as the assembly is moved into a wellbore which contains fluid, the wellbore fluid pressure will increase which can cause fluid to be expelled out of the wellbore at high pressure. The first valve means therefore enable wellbore fluid to move into and through the internal diameter of the assembly to facilitate deployment of the assembly and prevent fluid resistance.

In a preferred embodiment, said first valve means is arranged to close when fluid is pumped into the longitudinal bore from the surface to enable fluid pressure to increase in the assembly.

In a preferred embodiment, said first valve means comprises a spring loaded ball valve.

In a preferred embodiment, the assembly further comprises second valve means disposed in said second body portion, said second valve means arranged to permit fluid flowing in said first portion of said longitudinal bore to be exhausted from the assembly when the assembly is moved into a wellbore containing fluid.

This provides the advantage of enabling wellbore fluid moving along the longitudinal bore of the assembly to be exhausted at a point further up above the wellbore from the elastomeric packer element.

In a preferred embodiment, said second valve means is arranged to close when fluid is pumped into the longitudinal bore from the surface to enable fluid pressure to increase in the assembly.

In a preferred embodiment, said second valve means comprises a spring loaded sleeve slidably mounted in said first portion of said longitudinal bore and a ball held captive said spring loaded sleeve, wherein when the assembly is moved into a wellbore containing fluid the ball urges said sleeve against said spring to open at least one exhaust port.

A preferred embodiment will now be described, by way of example only and not in any limitative sense, with reference to the accompanying drawings in which.

Figure 1:
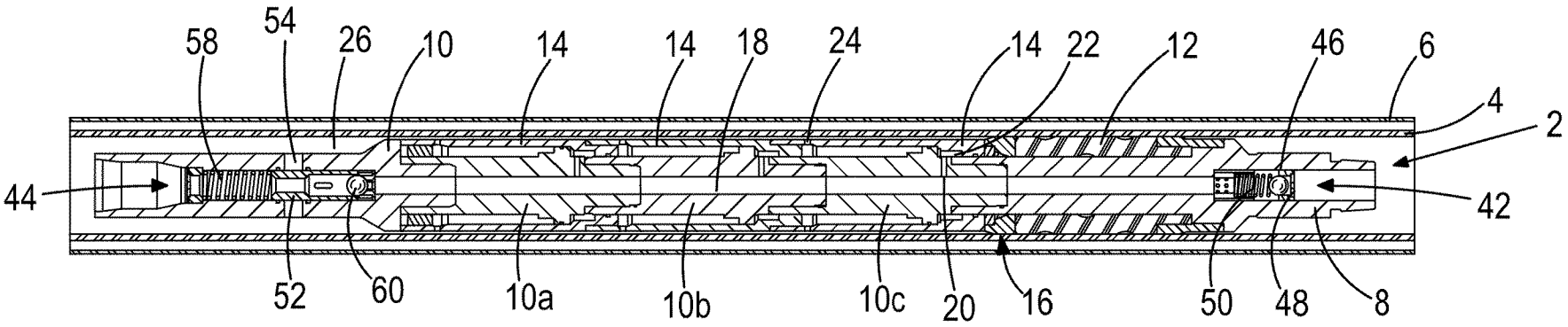
FIG. 1 is a longitudinal cross sectional view of an embodiment of a packer assembly for deforming wellbore casing.

Referring to FIGS. 1 to 5, a packer assembly 2 for deforming casing 4 comprises a first body portion 8 removably connectable to a second body portion 10. An elastomeric packer element 12 is disposed on the first body portion 8 and is configured to be deformed into an outwardly deployed condition (FIGS. 3 and 5) in response to actuation of at least one piston 14 disposed on the second body portion 10.

A locking means 16 is disposed on the first body portion 8 and is configured to retain the elastomeric packer element 12 in the outwardly deployed condition after it has deformed casing 4. The first body portion 8 can be disconnected from the second body portion 10 after the elastomeric packer element is deployed to deform casing 4 to enable retrieval of the second body portion 10 from the wellbore.

Figure 5:
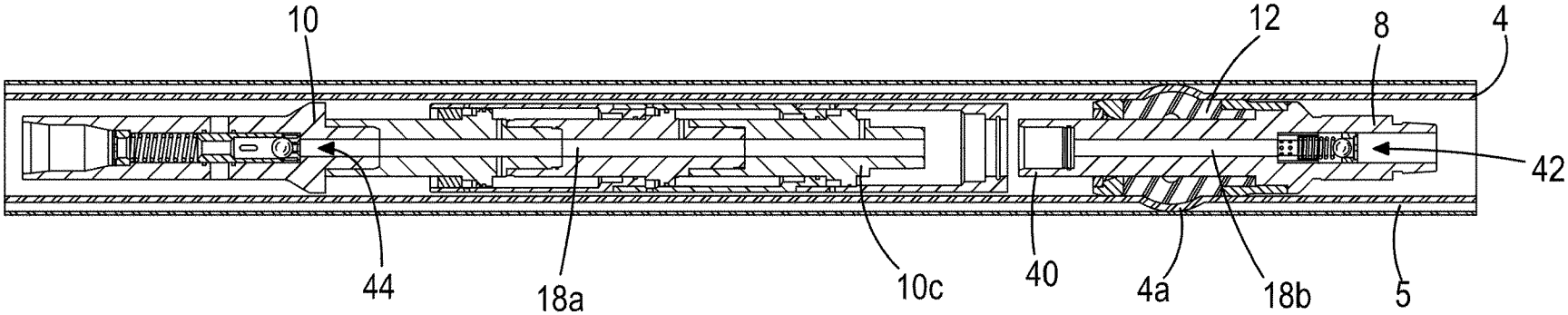
FIG. 5 is a longitudinal cross sectional view of the packer assembly of FIG. 1 in the separated condition.

In the fully assembled condition as shown in FIG. 1, the packer assembly defines a longitudinal bore 18 which passes through both the first and second body portions 8 and 10. When separated as shown in FIG. 5, the longitudinal bore comprises a first part 18*a* and a second part 18*b*. Piston 14 comprises a piston chamber 22 in fluid communication with the longitudinal bore 18 via internal port 20. Annular port 24 is provided to enable wellbore fluid to be exhausted during actuation of the piston 14. It can be seen that a plurality of pistons 14 (three in the embodiment shown) are mounted in a stacked configuration in series on the second body portion 10. The second body portion 10 is partially formed from a plurality of interconnected elements 10*a*, 10*b* and 10*c* which correspond to the number of pistons.

Each piston has its own respective pressure chamber 22, internal port 20 and annular port 24 to enable operation in series. Increasing the number of pistons increases the area available in piston chambers 22 on which pressurised fluid pumped into longitudinal bore 18 from the surface can act to increase the force available to drive the deformed elastomeric packer element into casing 4 to cause deformation. Provided the pressure inside longitudinal bore 18 is greater than the pressure in the annulus 26 outside of the assembly 2 then the differential pressure will enable the pistons to move and deform elastomeric packer element 12. Due to the modular nature of pistons 14 and body portions 10*a* 10*b* and 10*c*, the number of pistons can be adjusted as required to enable the operator to choose the force that can be applied to the elastomeric packer element 12.

Figure 4:
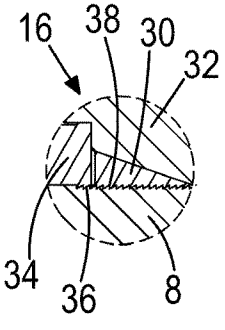
FIG. 4 is a close up detail of Box A of FIG. 3 showing the locking means of the packer assembly.
Figure 3:
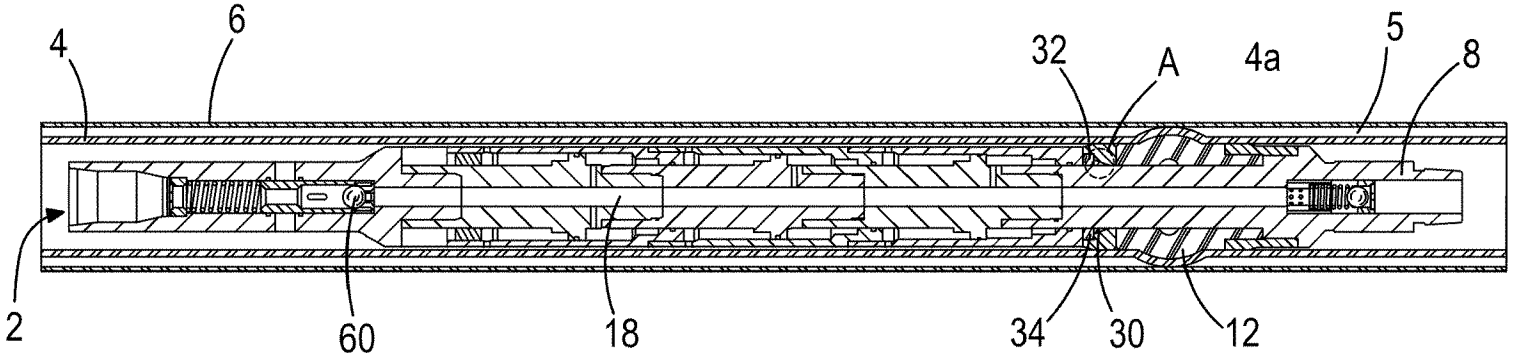
FIG. 3 is a longitudinal cross sectional view of the packer assembly of FIG. 1 in the condition in which fluid is pumped into the assembly to deploy the elastomeric packer element outwardly and deform casing.

Referring to FIGS. 3 and 4, locking means 16 comprises a ratchet member 30 in the form of a split ring which is held in place on the first body portion 8 by a retainer ring 32 and an axial retainer 34. A first plurality of teeth 36 is formed on the surface of the first body portion 8 and a second plurality of teeth 38 is formed on the internal surface of ratchet member 30. The configuration of the respective sets of teeth 36 and 38 enable the ratchet member 30 to skip over teeth 36 as it moves in the direction of compression of elastomeric packer element 12 (to the right in the drawings which corresponds to the downhole direction). However, the configuration of teeth 36 and 38 prevent the ratchet member 30 moving in the opposite direction (to the left in the drawings) such that once deployed, the elastomeric packer element 12 is held in the deformed condition.

The first body portion 8 and second body portion 10 can be disconnected from one another. A left hand thread (not shown) is formed in collar portion 40 of the second body portion 8 and a corresponding thread is formed on second body portion 10*c*. When the elastomeric packer element 12 is deployed to deform casing 4 as shown in FIG. 5, the elastomeric packer element 12 grips the casing to provide a reaction force as first body portion 10 is unscrewed in the clockwise (right hand) direction. In a preferred embodiment, 20 turns to the right causes disconnection. It is generally more straightforward for wellbore operators to rotate a work string to the right. This enables retrieval of the first body portion 10 and the hydraulic section formed from pistons 14 to the surface for reuse. First body portion 8 remains downhole in deformed casing 4.

Figure 7:
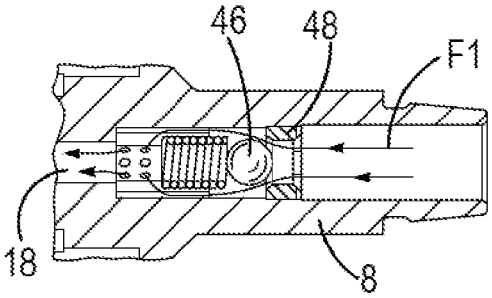
FIG. 7 is a close up longitudinal cross sectional view of the lower fluid bypass section.
Figure 8:
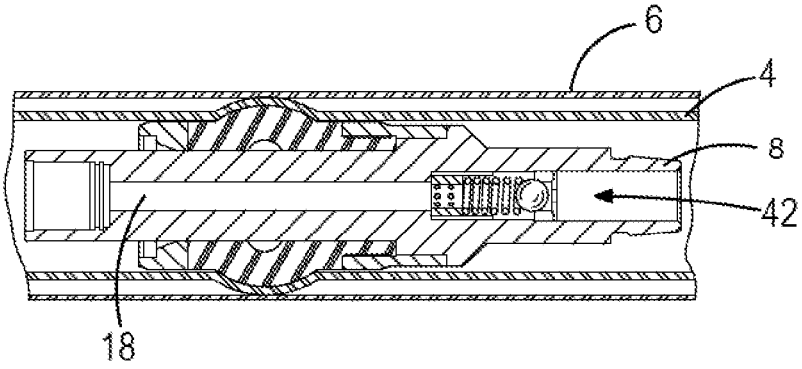
FIG. 8 is a longitudinal cross sectional close up view of the first body portion in the condition left in the wellbore.

The assembly 2 is required to have very close tolerance with the internal diameter of casing 4. As a consequence, if the assembly 2 is moved into a wellbore which is full of fluid, the fluid requires space to move. This is facilitated by a fluid bypass formed from first valve means 42 and second valve means 44. First valve means 42 comprises a first ball 46 which is urged into contact with first ball seat 48 by first spring 50. When the assembly 2 is moved into a wellbore containing fluid, the fluid in the wellbore pushes against first ball 46 to lift it off first seat 48 such that the fluid can move along fluid path "F1" and into longitudinal bore 18 as shown in FIG. 7.

Figure 6:
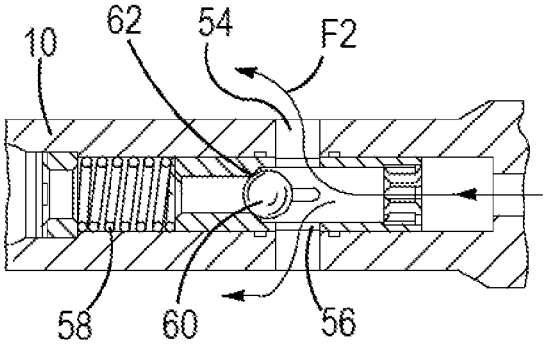
FIG. 6 is a close up longitudinal cross sectional view of the upper fluid bypass section.

The second valve means 44 comprises a slidable sleeve 52 which is slidable along longitudinal bore 18 relative to exhaust ports 54. Slidable sleeve 52 has ports 56 which correspond in dimension to exhaust ports 54. Slidable sleeve 52 is biased into the closed position by second spring 58. A second ball 60 can be pushed against second seat 62 to compress second spring 58 when wellbore fluid moves up longitudinal bore 18 along fluid path "F2" of FIG. 6. This enables wellbore fluid to be vented through exhaust ports 54. The rest position of second valve means 44 is shown in FIG. 1 in which exhaust ports 54 are blocked by slidable sleeve 52 under the action of second spring 58.

Operation of the packer assembly 2 will now be described through the stages of deployment, deformation of a wellbore casing 4, separation and retrieval of the hydraulic section to the surface.

Referring to FIG. 1, the packer assembly 2 in the assembled condition ready for deployment into a wellbore is shown. It can be seen that first spring 50 biases first ball 46 against first ball seat 48 to close the first valve means 42 and second spring 58 biases sliding sleeve 52 into a position to block exhaust ports 54 closing the second valve means 44.

Figure 2:
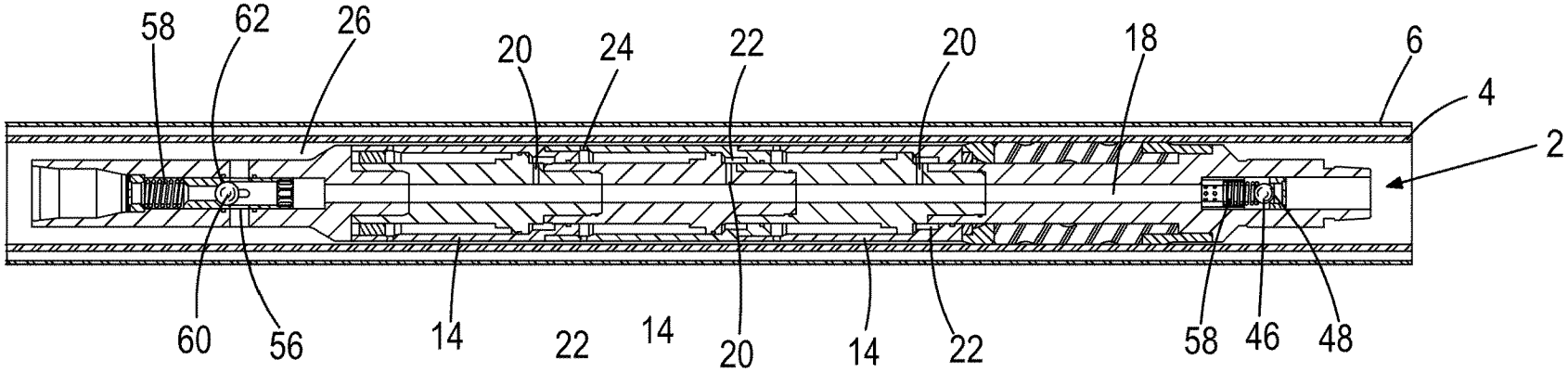
FIG. 2 is a longitudinal cross sectional view of the packer assembly of FIG. 1 in the condition in which the fluid bypass is in operation to enable deployment into a wellbore.

Referring to FIG. 2, as the assembly 2 is moved downwardly through casing 4 into the wellbore and fluid is encountered, the fluid resistance pushes first ball 46 off first seat 48 to compress spring 58 and create a fluid path into longitudinal bore 18 as shown by fluid path "F1" in FIG. 7. This fluid then pushes second ball 60 against second seat 62 to compress second spring 58, sliding the sleeve 52 upwardly to align ports 56 with exhaust ports 54 to enable the wellbore fluid to escape as shown in fluid path "F2" of FIG. 6.

Referring to FIG. 3, when the packer assembly 2 is in the desired location in the wellbore, since downward deployment into fluid has stopped, there is no fluid resistance to open the first and second valve means 42 and 44. First spring 58 therefore causes the first ball 46 to seat against first seat 48 closing the first valve means 42. Second spring 58 pushes the sliding sleeve downwardly to block exhaust ports 54. As a consequence, when fluid is pumped from the surface it cannot escape. The operator on the surface now activate pumps (not shown) to pump pressurised fluid along longitudinal bore 18. The fluid pumped from the surface passes through internal ports 20 into piston chambers 22 to cause the pistons 14 to move downwardly. This compresses the elastomeric packer element 12 to deform casing 4 outwardly at deformation 4*a*. The deformed portion of casing 4*a* contacts outer casing 6 to block annulus 5 and prevent fluid communication from annulus 5 to the surface. In a wellbore containing two or more concentric casings, the deformation could be made to extend across several concentric casings to seal a plurality of annuli, for example:

7 inch casing expanded into 9.5 inch casing with an 8.75 inch inner diameter or 8.5 inch open hole.

7 inch casing expanded into 9.5 inch casing and at the same time expand the 9.5 inch casing into a 13⅜ inch casing or 12.25 inch open hole to create a barrier across two annuli.

As the elastomeric packer element 12 is expanding, ratchet member 30 rides along the first plurality of teeth 36. When fluid pressure is removed, elastomeric packer element 12 pushes back on ratchet retainer 32. However, the engagement between second plurality of teeth 38 with the first plurality of teeth 36 prevents ratchet member 30 moving up the first body portion 8 to maintain the elastomeric packer element 12 in the outwardly deployed condition.

Referring to FIG. 5, the operator can then rotate the first body portion 10 in an clockwise direction to unscrew the first body portion and separate it from the second body portion 8. This leaves a permanent barrier in the wellbore which can serve as a seat for cement. The expanded packer element remaining downhole therefore acts as a bridge plug and does not allow any elastic relaxation of the expanded casing. The first valve means 42 will block the longitudinal bore 18 to prevent cement from moving past the first body portion 8.

It will be appreciated by persons skilled in the art that the above embodiment has been described by way of example only and not in any limitative sense, and that various alterations and modifications are possible without departure from the scope of protection as defined by the appended claims.

The invention claimed is:

1. A packer assembly for deforming casing located in a wellbore, the assembly comprising:

a first body portion removably connectable to a second body portion;

an elastomeric packer element disposed on said first body portion, said elastomeric packer element configured to be deformed into an outwardly deployed condition in response to actuation of at least one piston disposed on said second body portion;

locking means disposed on said first body portion to retain said elastomeric packer element in the outwardly deployed condition;

wherein said first body portion is configured to be disconnected from said second body portion after said elastomeric packer element is moved to the outwardly deployed condition to deform casing in said wellbore in which the assembly is disposed to enable retrieval of said second body portion from said wellbore, and wherein said second body portion defines a first portion of a longitudinal bore and wherein said at least one piston is mounted concentrically to said first portion of said longitudinal bore on said second body portion;

said at least one position further comprising a piston chamber in fluid communication with said first portion of said longitudinal bore such that an increase in fluid pressure in said first portion of said longitudinal bore causes said at least one piston to move along said second body portion to push said elastomeric packer element and deform said elastomeric packer element into the outwardly deployed condition.

2. An assembly according to claim 1, further comprising at least one annular port configured to vent wellbore fluid during operation of said at least one piston.

3. An assembly according to claim 1, comprising a plurality of pistons mounted in series on said second body portion.

4. An assembly according to claim 1, wherein said locking means comprises:

a first plurality of teeth disposed on an outer surface of said first body portion; and a ratchet member having a second plurality of teeth disposed thereon for engagement with said first plurality of teeth;

wherein said ratchet member is movable in a first direction along said first body portion during deformation of said elastomeric packer element but is prevent from movement in a second direction, opposite to said first direction by engagement of said first and second pluralities of teeth.

5. An assembly according to claim 4, wherein said ratchet member comprises a split ring.

6. An assembly according to claim 4, wherein said locking means further comprises a ratchet retainer ring in engagement with said elastomeric packer element.

7. An assembly according to claim 1, wherein said first and second body portions are connectable by corresponding screw threads.

8. An assembly according to claim 7, wherein said second body portion is configured to be disconnected from said first body portion by unscrewing the second body portion in the clockwise direction relative to said first body portion.

9. An assembly according to claim 1, wherein said first body portion defines a second portion of said longitudinal bore, and wherein said first body portion comprises first valve means disposed in said second portion of said longitudinal bore, the first valve means arranged to permit fluid to enter said second portion of said longitudinal bore when the assembly is moved into said wellbore containing fluid.

10. An assembly according to claim 9, wherein said first valve means is arranged to close when fluid is pumped into the longitudinal bore from the surface to enable fluid pressure to increase in the assembly.

11. An assembly according to claim 9, wherein said first valve means comprises a spring loaded ball valve.

12. An assembly according to claim 9, further comprising second valve means disposed in said second body portion, said second valve means arranged to permit fluid flowing in said first portion of said longitudinal bore to be exhausted from the assembly when the assembly is moved into said wellbore containing fluid.

13. An assembly according to claim 12, wherein said second valve means is arranged to close when fluid is pumped into the longitudinal bore from the surface to enable fluid pressure to increase in the assembly.

14. An assembly according to claim 12, wherein said second valve means comprises a spring loaded sleeve slidably mounted in said first portion of said longitudinal bore and a ball held captive said spring loaded sleeve, wherein when the assembly is moved into said wellbore containing fluid the ball urges said sleeve against said spring to open at least one exhaust port.

* * * * *